US011028647B2

(12) United States Patent
Batarseh

(10) Patent No.: US 11,028,647 B2
(45) Date of Patent: Jun. 8, 2021

(54) LASER DRILLING TOOL WITH ARTICULATED ARM AND RESERVOIR CHARACTERIZATION AND MAPPING CAPABILITIES

(71) Applicant: Saudi Arabian Oil Company, Dhahran (SA)

(72) Inventor: Sameeh Issa Batarseh, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 56 days.

(21) Appl. No.: 16/439,383

(22) Filed: Jun. 12, 2019

(65) Prior Publication Data

US 2020/0392793 A1 Dec. 17, 2020

(51) Int. Cl.

| | |
|---|---|
| ***E21B 7/15*** | (2006.01) |
| ***E21B 43/16*** | (2006.01) |
| ***E21B 43/12*** | (2006.01) |

(52) U.S. Cl.

CPC ..... *E21B 7/15* (2013.01); *E21B 43/126* (2013.01); *E21B 43/16* (2013.01)

(58) Field of Classification Search

CPC . E21B 7/15; E21B 7/046; E21B 43/16; E21B 43/26

See application file for complete search history.

(56) References Cited

U.S. PATENT DOCUMENTS

| | | | | |
|---|---|---|---|---|
| 6,470,978 | B2 * | 10/2002 | Trueman | E21B 7/061 175/67 |
| 6,755,262 | B2 | 6/2004 | Parker | |
| 6,880,646 | B2 | 4/2005 | Batarseh | |
| 6,888,097 | B2 | 5/2005 | Batarseh | |
| 2009/0222209 | A1 * | 9/2009 | Morys | G01V 11/005 702/9 |
| 2012/0074110 | A1 * | 3/2012 | Zediker | B23K 26/1224 219/121.72 |
| 2013/0000906 | A1 | 1/2013 | Schultz et al. | |
| 2014/0182933 | A1 | 7/2014 | Skinner et al. | |
| 2014/0360778 | A1 | 12/2014 | Batarseh | |
| 2015/0129203 | A1 | 5/2015 | Deutch et al. | |
| 2016/0273325 | A1 * | 9/2016 | Montaron | E21B 43/11 |
| 2017/0191314 | A1 | 7/2017 | Faircloth et al. | |

FOREIGN PATENT DOCUMENTS

| | | | |
|---|---|---|---|
| CN | 203081295 | U | 7/2013 |
| CN | 203334954 | U | 12/2013 |
| WO | WO-2005/001239 | A1 | 1/2005 |
| WO | WO-2016/090229 | A1 | 6/2016 |
| WO | WO-2020/250021 | A1 | 12/2020 |

OTHER PUBLICATIONS

International Search Report for PCT/IB19/56764, 5 pages (dated Mar. 9, 2020).

Written Opinion for PCT/IB19/56764, 8 pages (dated Mar. 9, 2020).

* cited by examiner

*Primary Examiner* — D. Andrews

(74) *Attorney, Agent, or Firm* — Choate, Hall & Stewart LLP; Charles E. Lyon; Alexander D. Augst

(57) ABSTRACT

This application relates to systems and methods for stimulating hydrocarbon bearing formations using a downhole laser tool.

22 Claims, 7 Drawing Sheets

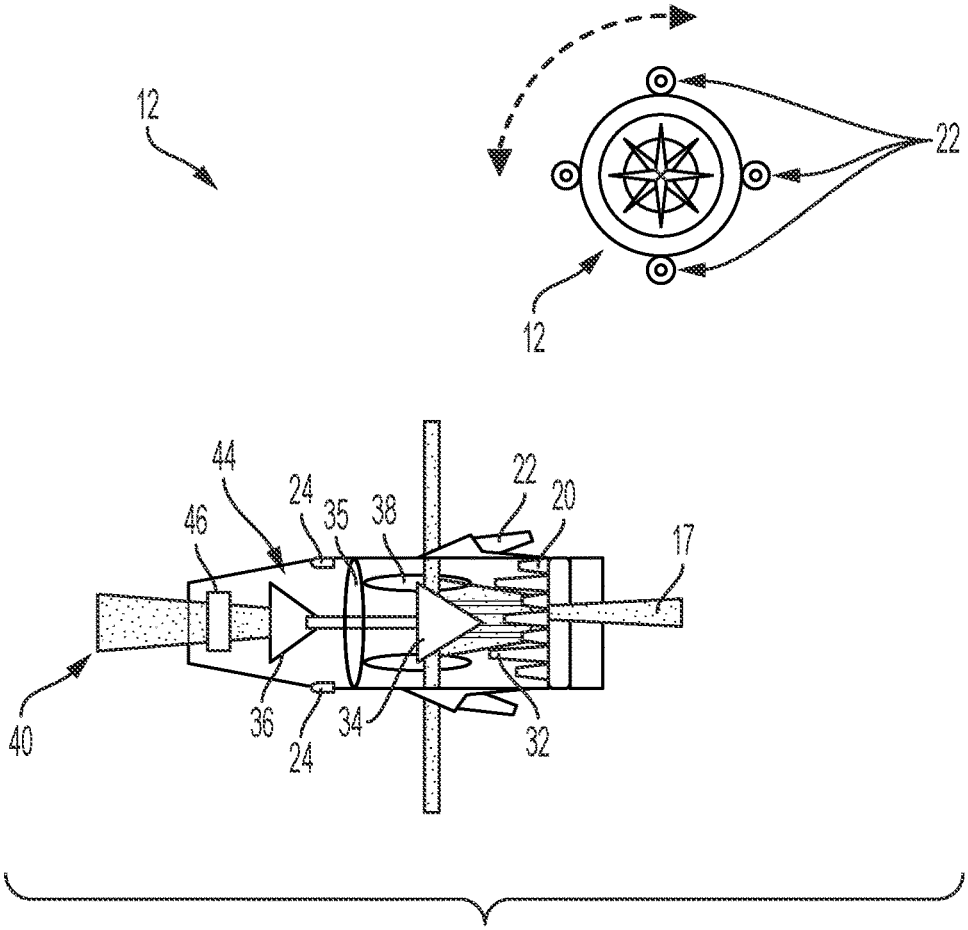
FIG. 2
FIG. 3A
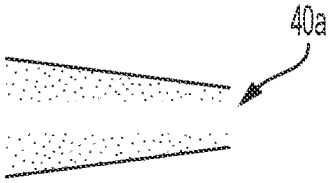
FIG. 3B
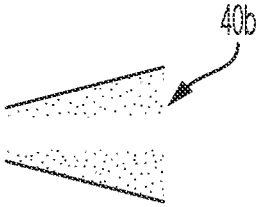
FIG. 3C
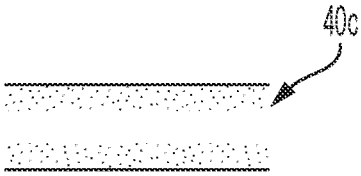

LASER DRILLING TOOL WITH ARTICULATED ARM AND RESERVOIR CHARACTERIZATION AND MAPPING CAPABILITIES

TECHNICAL FIELD

This application relates to laser tools and related systems and methods for stimulating hydrocarbon bearing formations using high-power lasers.

BACKGROUND

Wellbore stimulation is a branch of petroleum engineering focused on ways to enhance the flow of hydrocarbons from a formation to the wellbore for production. To produce hydrocarbons from the targeted formation, the hydrocarbons in the formation need to flow from the formation to the wellbore in order to be produced and flow to the surface. The flow from the formation to the wellbore is carried out by the means of formation permeability. When formation permeability is low, stimulation is applied to enhance the flow. Stimulation can be applied around the wellbore and into the formation to build a network in the formation. The first step for stimulation is commonly perforating the casing and cementing in order to reach the formation. One way to perforate the casing is the use of a shaped charge. Shaped charges are lowered into the wellbore to the target release zone. The release of the shaped charge creates short tunnels that penetrate the steel casing, the cement and into the formation.

The use of shaped charges has several disadvantages. For example, shaped charges produce a compact zone around the tunnel, which reduces permeability and therefore production. The high velocity impact of a shaped charge crushes the rock formation and produces very fine particles that plug the pore throat of the formation reducing flow and production. There is the potential for melt to form in the tunnel. There is no control over the geometry and direction of the tunnels created by the shaped charges. There are limits on the penetration depth and diameter of the tunnels. There is a risk in involved while handling the explosives at the surface.

The second stage of stimulation typically involves pumping fluids through the tunnels created by the shaped charges. The fluids are pumped at rates exceeding the formation breaking pressure causing the formation and rocks to break and fracture, this is called hydraulic fracturing. Hydraulic fracturing is carried out mostly using water based fluids called hydraulic fracture fluid. The hydraulic fracture fluids can be damaging to the formation, specifically shale rocks. Hydraulic fracturing produces fractures in the formation, creating a network between the formation and the wellbore.

Hydraulic fracturing also has several disadvantages. First, as noted above, hydraulic fracturing can be damaging to the formation. Additionally, there is no control over the direction of the fracture. Fractures have been known to close back up. There are risks on the surface due to the high pressure of the water in the piping. There are also environmental concerns regarding the components added to hydraulic fracturing fluids and the need for the millions of gallons of water required for hydraulic fracturing.

High power laser systems can also be used in a downhole application for stimulating the formation via, for example, laser drilling a clean, controlled hole. Laser drilling typically saves time, because laser drilling does not require pipe connections like conventional drilling, and is a more environmentally friendly technology with far fewer emissions, as the laser is electrically powered. However, there are still limitations regarding the placement and maneuverability of a laser tool for effective downhole use.

SUMMARY

Conventional methods for drilling holes in a formation have been consistent in the use of mechanical force by rotating a bit. Problems with this method include damage to the formation, damage to the bit, and the difficulty to steer the drilling assembly with greater accuracy. Moreover, drilling through a hard formation has proven very difficult, slow, and expensive. However, the current state of the art in laser technology can be used to tackle these challenges. Generally, because a laser provides thermal input, it will break the bonds and cementation between particles and simply push them out of the way. Drilling through a hard formation will be easier and faster, in part, because the disclosed methods and systems will eliminate the need to pull out of the wellbore to replace the drill bit after wearing out and can go through any formation regardless of its compressive strength.

The present disclosure relates to new tools and methods for drilling a hole(s) in a subsurface formation utilizing high power laser energy. In particular, various embodiments of the disclosed tools and methods use a high powered laser(s) with a laser source (generator) located on the surface, typically in the vicinity of a wellbore, with the power conveyed via optical transmission media, such as fiber optic cables, down the wellbore to a downhole target via a laser tool. Generally, the tool described in this application can drill, perforate, and orient itself in any direction. The tool includes means for high definition measuring and logging information about the formation, for example, if there is a salt dome, the tool will send acoustic waves, based on the velocity, the tool will be guided to follow the same velocity that represents the boundaries of the salt dome. The high definition reservoir characterizations are based on live and actual measurements, instead of software and correlation predictions. Live feedback on the formation properties allows drilling and completion decisions to be made instantly. Live acoustic images while drilling and perforating can be provided via the included acoustic cameras.

Generally, the laser generating unit is configured to generate a high power laser beam. The laser generating unit is in electrical communication with the fiber optic cable. The fiber optic cable is configured to conduct the high power laser beam. The fiber optic cable includes an insulation cable configured to resist high temperature and high pressure, a protective laser fiber cable configured to conduct the high power laser beam, a laser surface end configured to receive the high power laser beam, a laser cable end configured to emit a raw laser beam from the fiber optic cable. In some embodiments, the system includes an optional outer casing or housing placed within an existing wellbore that extends within a hydrocarbon bearing formation to further protect the fiber optic cable(s), power lines, or fluid lines that make up the laser tool.

In various embodiments, the laser tool includes an optical assembly configured to shape a laser beam for output. The laser beam may have an optical power of at least one kilowatt (1 kW). In some embodiments, the laser beam has an optical power of up to 10 kW. The laser tool provides the means to drill, perforate and establish communication between the wellbore and formation for maximum production and characterization. It is an integrated tool that combines high power and low power laser (fiber optics sensing), orientation means, acoustic cameras, an optical assembly and an articulated robotics arm known as a "snake." The tool is capable of drilling holes and characterizing the formation in any direction and at any length regardless of the rock strength, stress orientation or formation type.

The disclosed tools and methods provide non-damaging alternative technologies for downhole stimulations that can penetrate in any direction and evaluate the formation while penetrating. The disclosed tools and methods can improve communications between the wellbore and the hydrocarbon bearing formation to improve production and formation characterization. The fiber optics cable can be embedded in an articulated robotic snake that can be powered by electricity or hydraulic/pneumatic controls.

In one aspect, the application relates to a system for stimulating a hydrocarbon-bearing formation. In particular, a laser perforation tool configured for use in a downhole environment of a wellbore within a rock formation. The tool includes perforation means configured for perforating the wellbore, where the perforation means include one or more optical transmission media that is part of an optical path originating at a laser generating unit configured to generate a raw laser beam. The one or more optical transmission media is configured for passing the raw laser beam. The tool also includes a laser head coupled to the one or more optical transmission media and configured for receiving the raw laser beam, where the laser head includes an optical assembly for controlling at least one characteristic of an output laser beam.

Additional features of the tool include: a purging assembly disposed at least partially within or adjacent to the laser head and configured for delivering a purging fluid to an area proximate the output laser beam; a plurality of orientation nozzles disposed about an outer circumference of the laser head, where the plurality of nozzles are configured to control an orientation of the laser tool within the wellbore; and a control system to control at least one of a motion or a location of the laser head or an operation of the optical assembly to direct the output laser beam within the wellbore.

In various embodiments of the foregoing aspect, the optical assembly includes a splitter prism configured for receiving the raw laser beam and splitting the raw laser beam into one or more beams and a collimator disposed downstream of the prism and configured to receive the one or more beams and produce the output laser beam having a particular size or shape. The optical assembly can also include at least one additional lens disposed between the prism and collimator for delivering the output beam substantially perpendicular to or angled relative to a central axis of the laser head.

In some embodiments, the collimator is configured to deliver the output laser beam substantially parallel to a central axis of the laser head. In various embodiments, the collimator is configured to deliver at least one of a diverging beam, a converging beam, or a focused or collimated beam.

In various embodiments, the purging system includes a plurality of purge nozzles disposed proximate the output laser beam and connected to a purge fluid supply. The purge nozzles are configured to deliver a purge fluid to an area proximate the output laser beam. In some embodiments, at least a portion of the purge nozzles are vacuum nozzles connected to a vacuum source and configured to remove debris and gaseous fluids from the area proximate the output laser beam.

In some embodiments, the plurality of orientation nozzles are purge nozzles configured to provide thrust to the laser head to move the laser head within the wellbore. The plurality of orientation nozzles can be movably coupled to the laser head to allow the orientation nozzles to rotate or pivot relative to the laser head to provide forward motion, reverse motion, rotational motion, or combinations thereof to the laser head relative to the wellbore.

In still other embodiments, the tool includes an articulated arm disposed between the laser head and the laser generating unit. The articulated arm can include a plurality of protective couplings disposed around the optical transmission media. In some embodiments, a flexible outer casing is disposed around the plurality of protective couplings. The articulated arm can include a snake robot having locomotion means for maneuvering the tool within the wellbore. The locomotion means can include at least one of an electrical motor or a hydraulic actuator.

In additional embodiments, the tool includes a centralizer coupled to the tool and configured to hold the tool in place relative to an outer casing in the wellbore. The centralizer can include a plurality of swellable packers.

In further embodiments, the tool includes at least one acoustic camera coupled to the tool and configured to relay an image of an area proximate the laser head. In some embodiments, the at least one acoustic camera is disposed on the outer circumference of the laser head. The acoustic camera can also be configured to characterize the formation.

In another aspect, the application relates to a method of using a laser tool to stimulate a hydrocarbon-bearing formation. The method includes the steps of passing, through one or more optical transmission media, a raw laser beam generated by a laser generating unit at an origin of an optical path that includes the optical transmission media; positioning a laser tool within a wellbore within the formation via an articulated arm, where the laser tool is coupled to the laser generating unit; orienting a laser head of the laser tool within the wellbore using a plurality of nozzles disposed about an outer circumference of the laser head; delivering the raw laser beam to an optical assembly disposed within the laser head; manipulating the raw laser beam with the optical assembly to produce an output laser beam; and delivering the output laser beam to the formation.

In various embodiments, the method includes the step of imaging an area proximate the laser head using the one or more acoustic cameras. The method can also include the step of characterizing the formation using the one or more acoustic cameras.

Definitions

In order for the present disclosure to be more readily understood, certain terms are first defined below. Additional definitions for the following terms and other terms are set forth throughout the specification.

In this application, unless otherwise clear from context, the term "a" may be understood to mean "at least one." As used in this application, the term "or" may be understood to mean "and/or." In this application, the terms "comprising" and "including" may be understood to encompass itemized components or steps whether presented by themselves or together with one or more additional components or steps. As used in this application, the term "comprise" and variations of the term, such as "comprising" and "comprises," are not intended to exclude other additives, components, integers or steps.

About, Approximately: as used herein, the terms "about" and "approximately" are used as equivalents. Unless otherwise stated, the terms "about" and "approximately" may be understood to permit standard variation as would be understood by those of ordinary skill in the art. Where ranges are provided herein, the endpoints are included. Any numerals used in this application with or without about/approximately are meant to cover any normal fluctuations appreciated by one of ordinary skill in the relevant art. In some embodiments, the term "approximately" or "about" refers to a range of values that fall within 25%, 20%, 19%, 18%, 17%, 16%, 15%, 14%, 13%, 12%, 11%, 10%, 9%, 8%, 7%, 6%, 5%, 4%, 3%, 2%, 1%, or less in either direction (greater than or less than) of the stated reference value unless otherwise stated or otherwise evident from the context (except where such number would exceed 100% of a possible value).

In the vicinity of a wellbore: As used in this application, the term "in the vicinity of a wellbore" refers to an area of a rock formation in or around a wellbore. In some embodiments, "in the vicinity of a wellbore" refers to the surface area adjacent the opening of the wellbore and can be, for example, a distance that is less than 35 meters (m) from a wellbore (for example, less than 30, less than 25, less than 20, less than 15, less than 10 or less than 5 meters from a wellbore).

Substantially: As used herein, the term "substantially" refers to the qualitative condition of exhibiting total or near-total extent or degree of a characteristic or property of interest.

Circumference: As used herein, the term "circumference" refers to an outer boundary or perimeter of an object regardless of its shape, for example, whether it is round, oval, rectangular or combinations thereof.

These and other objects, along with advantages and features of the disclosed systems and methods, will become apparent through reference to the following description and the accompanying drawings. Furthermore, it is to be understood that the features of the various embodiments described are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the disclosed systems and methods and are not intended as limiting. For purposes of clarity, not every component may be labeled in every drawing. In the following description, various embodiments are described with reference to the following drawings, in which:

FIG. 2 is an enlarged lateral view of a laser head in accordance with one or more embodiments of the fiber optics laser perforation tool of FIG. 1;

FIGS. 3A-3C are simplified diagrams of various types of beams that can be transmitted by an optical assembly within the laser head in accordance with one or more embodiments of the fiber optics laser perforation tool of FIG. 1;

DETAILED DESCRIPTION

Figure 1:
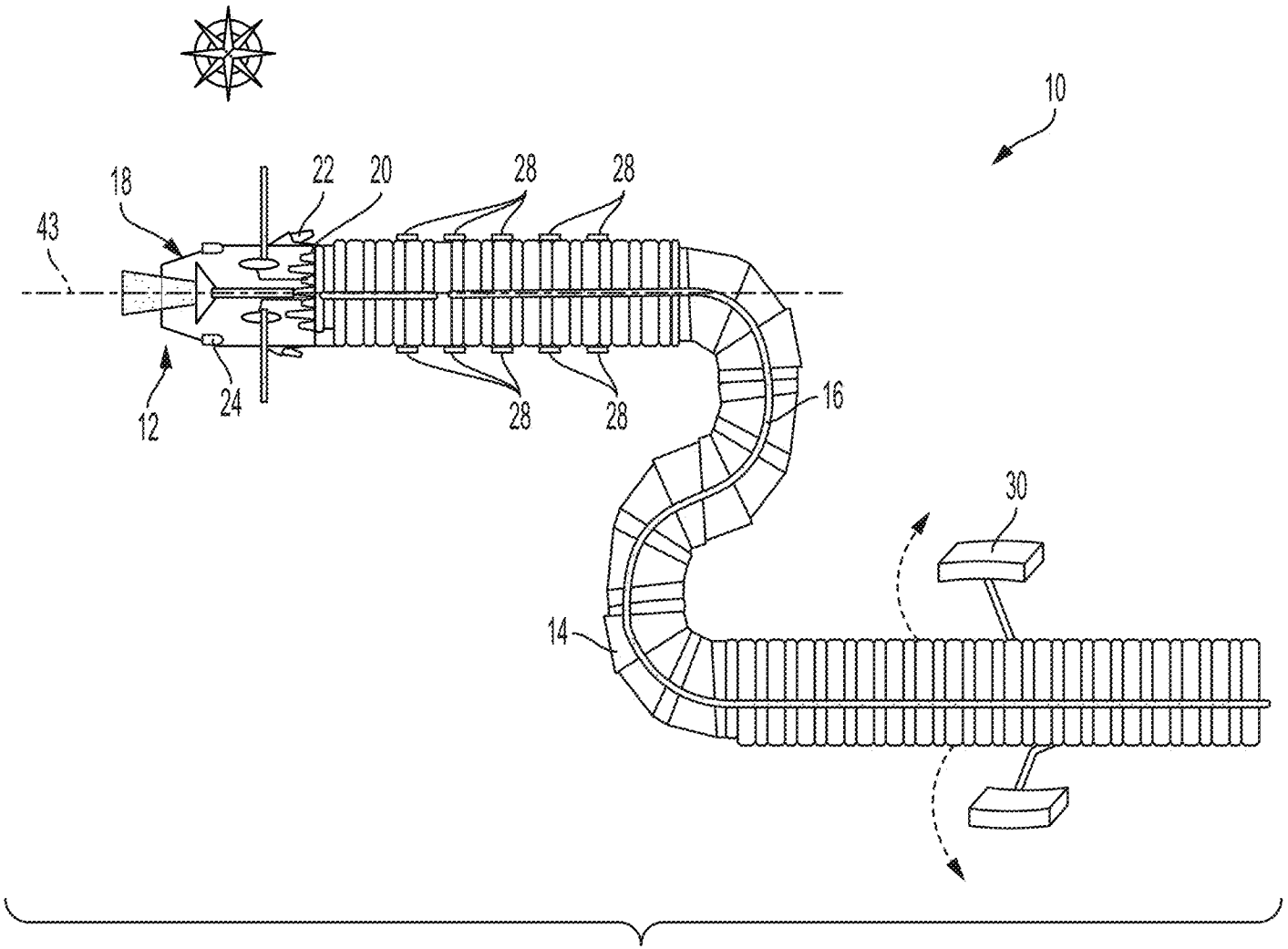
FIG. 1 is a simplified diagram of a portion of a fiber optics laser perforation tool in accordance with one or more embodiments.

FIG. 1 depicts a portion of a fiber optic laser perforation tool 10 that is configured to be lowered downhole via any service provider using a coiled tube unit, wireline, or tractors as known in the art. The tool 10 includes an articulated arm 14, which is sometimes referred to as a "snake robot" (see, for example, FIG. 5), and a laser head 12 that houses at least a portion of an optical assembly 18, includes a plurality of orientation nozzles 22 and a purging system 20. The tool 10 also includes swellable packers 30 to centralize the tool 10 and isolate a zone if needed to perform a specific task in that zone upon reaching a target. The packers 30 can be disposed at various points along the arm 14 as need to suit a particular application. The packers or centralizers 30 support the weight of the tool body and can be spaced along the tool 10 as needed to accommodate the tool 10 extending deeper into the formation. The packers 30 can also be flexible to allow the tool 10 to slide through them when they are expanded. The packers 30 are not limited to an elastomeric material that expands when wet, but could also include bladders that can be inflated hydraulically or pneumatically from the surface or by other mechanical means.

A cable 16 is disposed within the arm 14 and can include the optical transmission media (for example, fiber optics), along with any power or fluid lines as needed to operate the tool 10. The cable 16 extends from a laser generating unit 148 disposed on the surface (See FIG. 8) to the laser head 12. The laser head 12 (or a portion of the arm 14) can include one or more low power fiber optics sensors 28 for temperature and pressure logging, and one or more acoustic cameras 24 that are located around a circumference of the laser head 12. The function of the cameras 24 is to visualize the laser head 12 and the surrounding area, along with characterizing the formation. Typical downhole cameras will not work due to the fluids and contamination in the wellbore. The data captured from the acoustics 24 (besides the images) are the velocities of the sound waves that travel and are reflected within the formation, which can be used to calculate the mechanical properties of the formation, predict the formation stability, evaluate tool performance, and support tool orientation and troubleshooting. The laser head 12 is described in greater detail with respect to FIG. 2.

Generally, the acoustic sensing can provide information while drilling and guide the tool (similar to geo-steering) by measuring the densities of the formation. By knowing the density, the formation and structure will also be known. The integrated acoustics provide high definition reservoir characterization and mapping (see FIG. 9). For example, while the tool 10 is penetrating the formation, the tool will send live data to the surface to an operator, the operator can teach the tool 10 to stick to specific density ranges and not penetrate other ranges, for example, sandstone densities range between 2.2 to 2.6 grams per cubic centimeter (g/cc), so the tool will follow and penetrate only in sandstone and at the same time provide mapping of the sandstone structure. The acoustics also provide vision via the acoustic camera(s) 24. These features enable the tool 10 to target hydrocarbon zones only. Also, the information provided via the acoustics can be used to calculate the mechanical properties of the formation and generate tomographic images. Machine learning can also be utilized to "teach" the tool how to self-navigate the formation via the information provided by the acoustics 24 and fiber optic sensors 28.

The tool 10 can be programmed to navigate and drill in specified rock densities, with the acoustic sensing and the sound waves used as a monitoring tool to steer the snake 14. More specifically, the tool 10 will send and receive sound waves, and from the velocity differences, the tool can be directed to the target formation or identify particular subsurface structures, because the data is sent directly to the surface to control the snake robot, or the snake robot can be preprogrammed to analyze the velocity and steer based on these sound waves.

In addition, the acoustics 24 and fiber optic sensors 28 can be used to further characterize various features of the formation, such as hardness, composition, density, temperature, etc. To explain in more detail, the acoustics measure rock mechanical properties, produce images, for example, ultrasound and three-dimensional, in the fluid and rock environment, determine saturation levels, and fluid multiphase characterizations. The fiber optic sensors 28 enable temperature and pressure measurement while drilling. The fiber optic sensors 28 can sense a temperature of the formation, for example, the temperature of the face of the rock to determine if it is overheated due to the laser and, if so, the laser will shut-off to protect the tool 10. In various embodiments, the sensors can also monitor one or more other environmental conditions in the wellbore or one or more conditions of the tool 10, such as a surface temperature of the tool 10, mechanical stress in a wall of the wellbore, mechanical stress on the tool 10, flow of fluids in the wellbore, presence of debris in the wellbore, the pressure in the wellbore, or radiation, magnetic fields.

FIG. 2 depicts the laser head 12 in greater detail. As shown, the head 12 includes the optical assembly 18, the purging assembly 20, and the orientation nozzles 22. Generally, the laser head 12 includes a protective housing 44, which, in accordance with some embodiments, is a transparent housing formed of a glass or sapphire material. In some embodiments, only a distal end 46 of the housing 44 is transparent or includes a lens cover for emission of the output beam 40. Additionally or alternatively, the housing 44 can include at least one window disposed on a side thereof to accommodate directing the output beam 40 perpendicular to a central axis 43 of the tool 10. The raw laser output end of the cable 16 is operably connected to the optical assembly 18 within the housing 44. The optical assembly 18 is used to shape and deliver an output laser beam 40 to the wellbore.

Disposed within the laser head 12 is at least one laser beam directing means for focusing and aiming the direction of the laser beam 40. Generally, the raw laser beam 17 exits the cable 16 and goes into a splitter prism 34, the beam 17 can be split into different numbers of beams for side perforation with the use of additional splitters or focused lenses 38. The beam 17 can also travel straight by passing the splitter 34 into a collimator or focused lens 36. An additional lens 35 may be disposed between the splitter prism 34 and collimator or focused lens 36. Additionally or alternatively, a different fiber optical cable 16 can be used to suit different applications. Typically, the fiber optical cables 16 are very small in size, with the output beam size controlled to obtain different beam sizes, shapes, or both. The various beam sizes/shapes 40 are shown in FIGS. 3A-3C.

FIG. 3A depicts an embodiment where the output beam 40A has been conditioned for divergence (a conical shape, where the large base is projected forward of the head of the tool) to create a hole larger than the tool 10, so the tool can be advanced within the wellbore. FIG. 3B depicts an embodiment where the beam 40B has been conditioned as focused or converging (a conical shape, where the small or the focused shape is projected forward of the head of the tool) to perforate a head of the tool or weaken the formation before then using divergence to continue drilling. FIG. 3C depicts an embodiment where the beam 40C has been collimated (the beam has a substantially constant diameter) to drill a straight hole to reach a target without moving the tool forward.

The optical assembly 18 can include additional directing means, such as at least one movable reflector/mirror or one or more adjustable lenses to enable precise focusing and direction of the laser beam 40. It should be noted that the only requirements with respect to the use and disposition of reflectors and lenses within the laser head 12 are that the arrangement thereof permits splitting and/or redirecting of the raw laser beam in any direction by means of rotation or adjustment of the lenses and reflectors.

Figure 4:
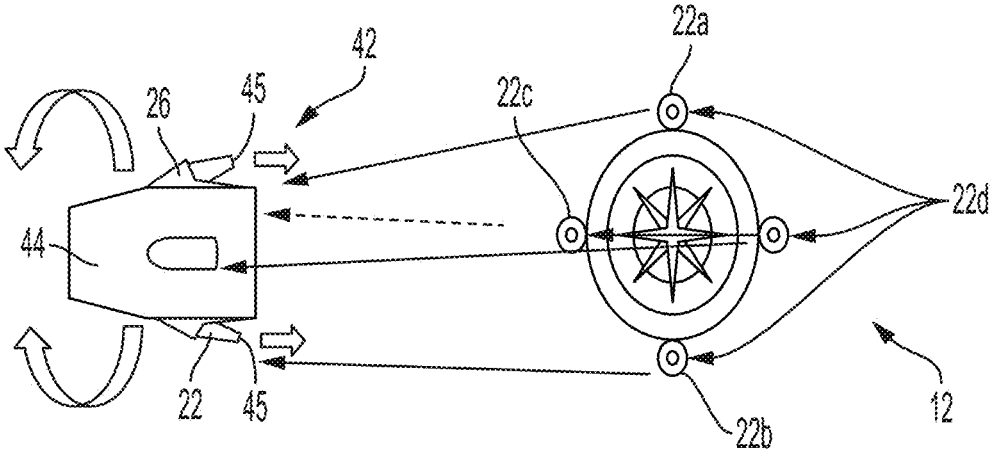
FIG. 4 is a simplified diagram of a portion of a drive system of the laser head in accordance with one or more embodiments of the fiber optics laser perforation tool of FIG. 1.

One of the features of the tool 10 is its precise control over the motion and location of the laser head 12 within the wellbore. FIGS. 2 and 4 depict the means for positioning and orienting the tool 10, in particular the laser head 12 within the wellbore. The tool 10 can also be positioned and oriented via the snake robot 14. Also provided are means for sensing the orientation and location of the tool 10 within the wellbore, such means including the various sensors and imaging previously described.

In the embodiment shown, the orientation means include a plurality of nozzles 22 disposed about the outer circumference of the laser head 12. The nozzles 22 can be coupled to the laser head housing via known mechanical means 26 as either fixed (for example, via fasters or bonding) or movable (for example, via a ball joint or servo motors). Typically, the nozzles 22 will be movably coupled to the laser head 12 and controlled via the control system to provide forward, reverse, or rotational motion to the laser head 12, and by extension the tool 10.

Generally, the tool 10/head 12 is oriented by controlling a flow of a fluid (either liquid or gas) through the nozzles 22. For example, by directing the flow of the fluid in a rearward direction 42 as shown in FIG. 4, the tool 10 will be pushed forward in the wellbore by utilizing thrust action, where the opening 45 of the nozzles 22 are facing the opposite directions of the tool head 12 and the fluid flows backward providing the thrust force moving the tool 10 forward. Controlling the flow rate will control the speed of the tool 10 within the wellbore. The fluid for providing the thrust can be supplied from the surface and delivered by a fluid line included within the cable 16.

As shown in FIG. 4 there are four (4) nozzles 22*a*, 22*b*, 22*c*, 22*d* evenly spaced around the laser head 12. Each nozzle 22 flows a fluid to allow to the tool to move and can be separately controlled. For example, if nozzle 22*a* is the only nozzle on, then the tool 10 will turn in the south direction, the turn degree depends on the controlled flow rate from that nozzle 22*a*. If all of the nozzles 22 are evenly turned on, then the tool will move linearly forward or in reverse depending on the position of the nozzles 22.

As previously mentioned, the nozzles 22 can be movably mounted to the laser head 12, for example, via servo motors with swivel joints that can control whether the nozzles ends 45 face rearward (forward motion), forward (reverse motion), or at an angle to the central axis 43 (rotational motion or a combination of linear and rotational motion depending on the angular displacement of the nozzle 22 relative to the central axis 43). For example, if the nozzles 22 are aligned perpendicular to the central axis, the nozzles 22 will only provide rotational motion. If the nozzles are parallel to the central axis 43, then the nozzles 22 will only provide linear motion. A combination of rotational and linear motion is provided for any other angular position relative to the central axis 43.

The fluid lines for providing the thrust can be coupled to the nozzles via swivel couplings as known in the art. In addition, in some embodiments, the tool 10 will get support to move from the coiled tubing unit on the surface, for example, where the weight of the tool 10 is too heavy to rely on only the orientation nozzles 22, and possibly the packers 30.

Referring back to FIG. 2, the purging assembly 20 includes a plurality of purge nozzles 32 disposed proximate the laser head 12 and configured for removing dust or other particles from the exterior surface of the laser head housing 44 and an area proximate to the laser head 12 to clear a path for the laser beam 40, as the debris will absorb energy, resulting in less energy delivered to the formation. Additionally, the debris can contaminate the cutting area and damage the laser head 12 or disrupt, bend, or scatter the laser beam 40. Suitable purging fluids may be gas, such as high pressure air, or liquids. The purge fluid should be transparent to the laser beam wavelength. In accordance with various embodiments, at least a portion of the nozzles 32 are vacuum nozzles connected to a vacuum source and adapted to remove debris and gaseous fluids from around the exterior of the laser head 12.

Figure 5:
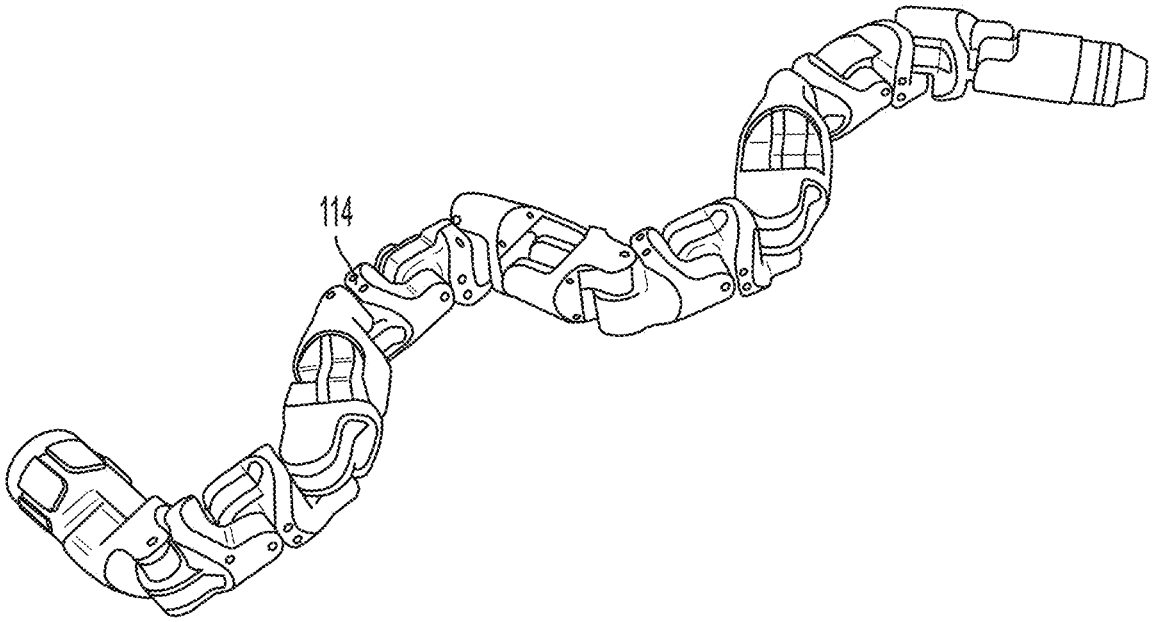
FIG. 5 is a pictorial representation of an articulated robotic arm for use in a fiber optics laser perforation tool in accordance with one or more embodiments.

FIGS. 5 and 6 depict examples of articulated arm structures that can be used with the tool 10. In particular, FIG. 5 depicts an actual articulated robotic arm (photo courtesy of biorobotics.ri.cmu.edu) that may be available "off-the-shelf" to reach locations where human material interaction is hazardous or, for example, in subsurface applications in the sea. Smaller robotic arms are used very widely in the medical field and there are many companies who manufacture these snakes, such as OC Robotics: Unit 5, Abbey Wood Business Park, Emma-Chris Way, Filton, Bristol, BS34 7JU, UK or FANUC or Yamaha in Japan. Generally, a snake robot is a slender hyper-redundant manipulator with a plurality of degrees of freedom that allow the arm to "snake" along a path or around an obstacle.

Figure 6A:
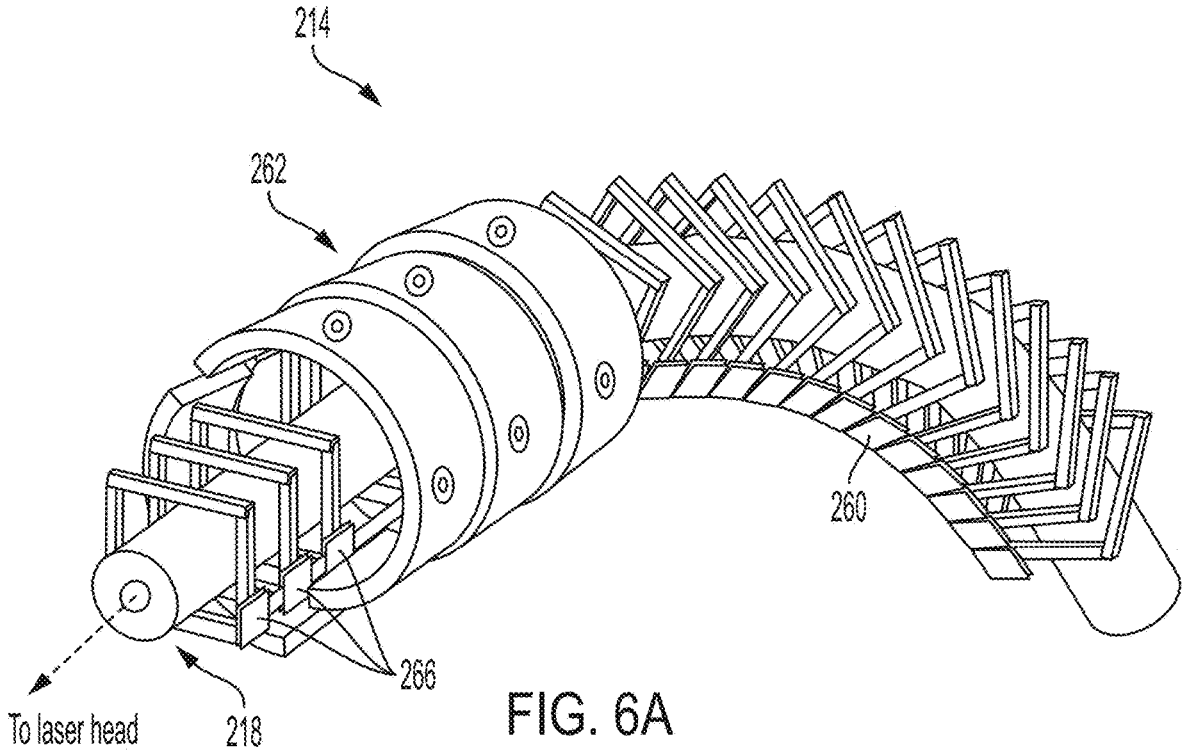
FIGS. 6A-6C are schematic representations of a snake robot for use with a fiber optics laser perforation tool in accordance with one or more embodiments.
Figure 6B:
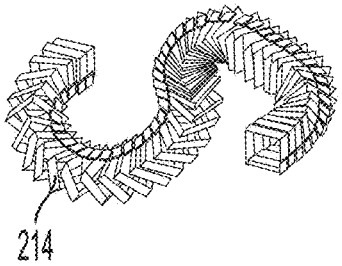
Figure 6C:
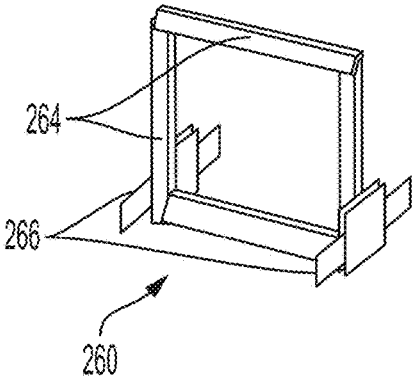

However, these standard or off-the-shelf type products will not work for the downhole application as is, it must be integrated with sensors and machine learning to suit the particular applications disclosed in this application. For example, the snake needs to be much longer to penetrate in the formation and may need to run on batteries so it is free from any string or attachment. FIGS. 6A-6C depict an exemplary embodiment of a snake arm 214, with FIG. 6A representing a partially exploded perspective view of the arm 214, FIG. 6B illustrating the precise maneuverability of the arm 214, and FIG. 6C representing one component of the arm 214.

As shown in FIG. 6A, the inner configuration of the articulated arm 214 includes a plurality of protective, maneuverable couplings 260 made up of reinforced braces 264 and interconnecting, flexible sliders 266 (see FIG. 6C) that can be powered by electric or hydraulic actuators to maneuver and move in any direction to provide the motion and orientation the articulated arm 214. The arm 214 also includes a plurality of telescoping outer coverings 262 that protect the cable 218 and other controls that run through the articulated arm.

Generally, these arms 214 are made in accordance with any of the existing, commercially available snake robots, such as those available from OC Robotics, FANUC, or Yamaha. In some embodiments, the modifications include incorporating additional joints/couplings to the snake to increase its length, attaching sensors to the couplings via conventional attachment means, or enlarging passageways through the couplings to accommodate the fiber optic cables.

Figure 7:
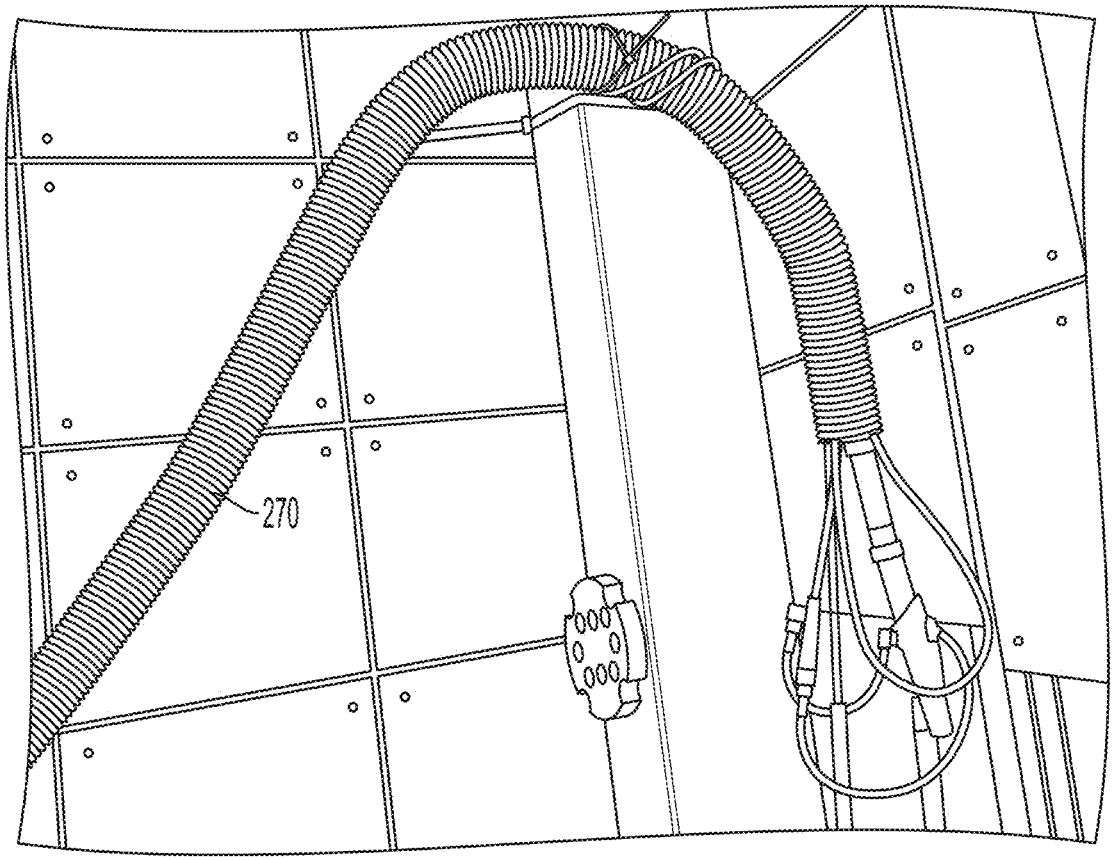
FIG. 7 is a pictorial representation of a flexible casing for use with an articulated robotic arm in accordance with one or more embodiments of the fiber optic laser perforation tool of FIG. 1.

The arm 214 may also include an outer case or flexible shield 270 to protect the tool from a downhole environment. Snake robot manufacturers use a variety of different materials to fabricate these cases; an example of a flexible, aluminum shield 270 is shown in FIG. 7. As shown, the shield 270 is not a part of the snake robot, but merely a protective case to prevent the ingress of contamination.

The advantages of the disclosed laser tool with articulated arm include that it can reach any target in the formation regardless of the geological structure, stress or hardness of the rocks, provides for faster drilling as no need for casing or moving tool in and out of the hole to change bits, it can bypass nonpaying zones, such as water, and target pay zones directly, and it can connect different isolated zones that are not aligned in the same direction. An example of the tool in operation is depicted in FIG. 8.

Figure 8:
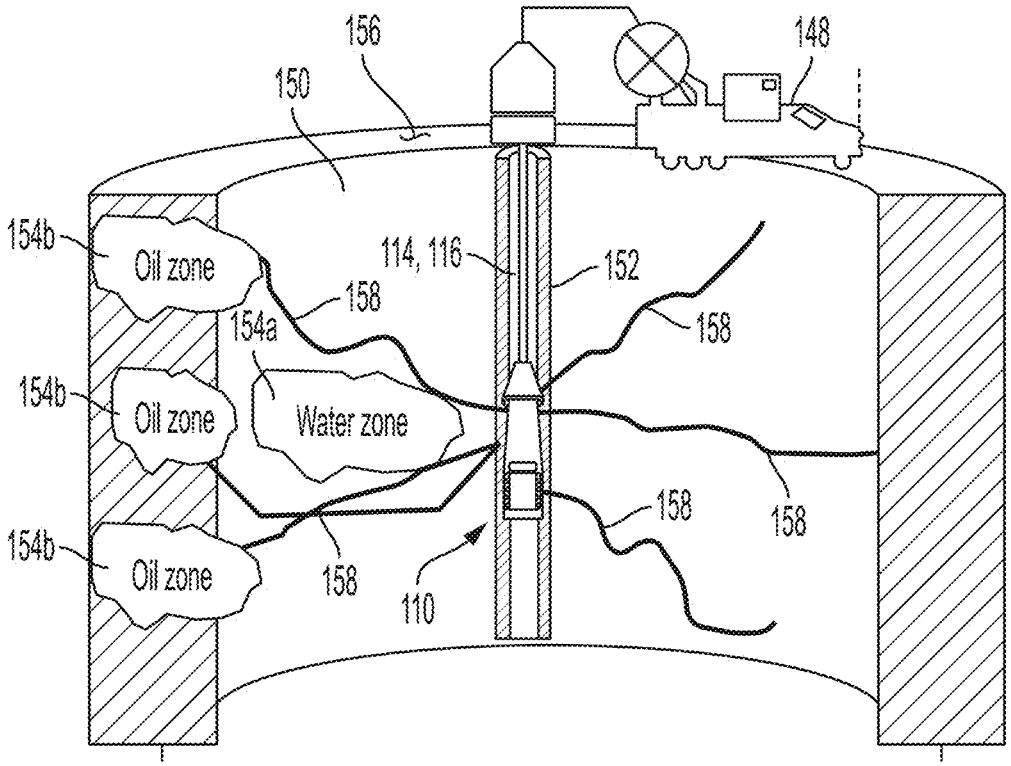
FIG. 8 is a simplified diagram showing a fiber optics laser perforation tool disposed within a wellbore within a formation and used in accordance with one or more embodiments.

FIG. 8 shows a fiber optic laser perforation tool 110 in accordance with one or more embodiments deployed within a wellbore 152 within a formation 150. In operation, the tool 110 is positioned within the wellbore 152 as previously described, so that the laser head can be positioned at the desired drilling locations. The laser tool 110 is coupled to the laser generating unit 148 located on the surface 156 as previously described. By virtue of this arrangement, there are no physical limitations, such as weight and size, on the downhole portion of the tool.

As further shown in FIG. 8, the laser is operated to penetrate a casing and cement of the wellbore 152 to form tunnels 158 therein. The tool 110, via its articulated arm/snake robotics, transports the laser head through the tunnel 158 and each type of medium that may be encountered, thereby enabling the creation of a substantially deeper tunnel 158. In addition to being able to drill a longer tunnel 158, the tool 110 is also able to act upon the surface of the tunnel 158 depending upon the power of the laser employed to produce varying degrees of permeability.

For applications in which high permeability is desired, the power and exposure time of the laser energy employed must be sufficient to vaporize the underground media encountered to form a vaporized zone. For moderate permeability, a lesser amount of laser energy is employed, which is sufficient to soften or melt the underground media for forming a permeable melt zone. For rendering the rock formation 150 impermeable, an even lesser amount of laser energy is employed to form a seal zone. These different levels of treatments are used to address the different strengths and stabilities of rock formations encountered.

Furthermore, the tool 110 can navigate through the formation 150 to target or avoid different zones 154. As shown, the tunnels 158 can be drilled through the formation at irregular paths, because the snake robotics and acoustics will navigate through the formation 150 avoiding, for example, water zones 154*a*, while targeting oil zones 154*b*. More specifically, as the tool 110 is drilling through the formation 150, it is also evaluating the formation 150, so if it senses a water zone 154*a*, the tool, via the snake robotics, can change the drilling direction of the tool to avoid the water zone 154*a*. The tool 110 will continue drilling until it reaches an oil zone (or other pay zone) 154*b* that can also be determined via the integrated acoustics.

Figure 9:
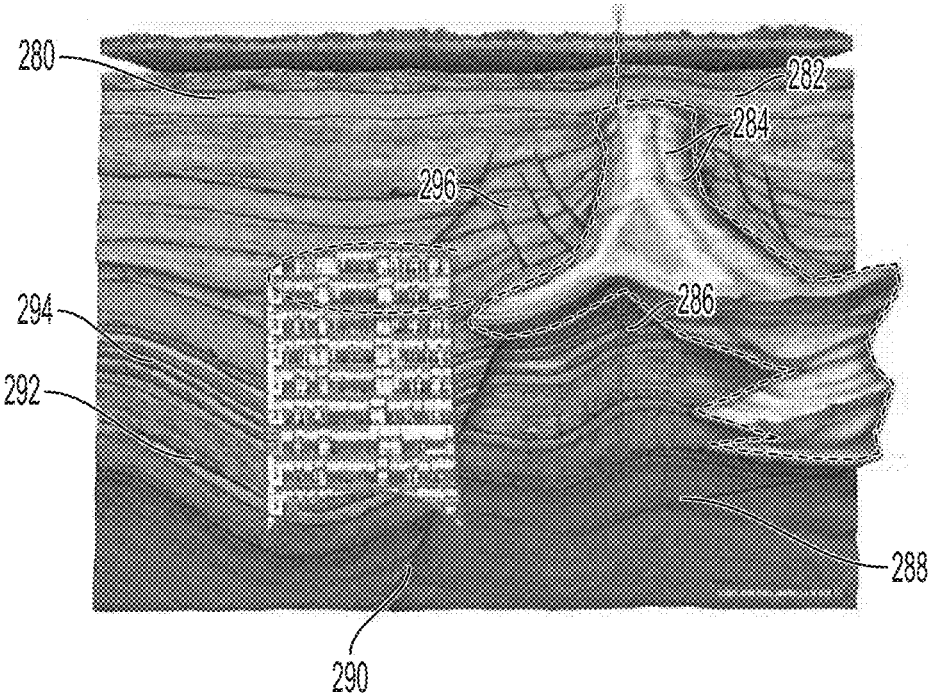
FIG. 9 is a tomographic image of a formation as generated by a fiber optic laser perforation tool in accordance with one or more embodiments.

FIG. 9 depicts a tomographic image that can be generated via the acoustics and other sensors integrated within the tool. Specifically, FIG. 9 illustrates an example of a complex subsurface structure consisting of geological features and structures, such as multiple layers 282, domes 284, hydrocarbon in thin layers 286, folds 288, major faults 290, syncline 292, multiple bedding 294 and multiple faults 296. These reservoir heterogeneities present challenges in today's current technology to map and characterize. The disclosed tool and related methods overcome these challenges by using the articulated robotic arm equipped with sensing and measuring tools, such as acoustic and fiber optic sensing to sense and characterize the subsurface formation. The structure of each layer will have different a density, the acoustics will measure the density and direct the robotic arm to follow specific density (machine learning can be applied) to obtain high definition mapping for the complex structure. The tool can also provide circular logging to confirm the information received by the tool.

Generally, conventional logging methods involve drilling wells and logging them, and then interpreting the relationship between the logs to find the geological structural and predict further structure based on the number of logs and wells. The disclosed tool 10, 110 is equipped with logging tools, such as the fiber optic sensors 28 that can provide temperature and pressure measurements and acoustic cameras 24 to provide sound wave velocities, such as shear (Vs), and longitudinal waves known as (Vp). From these velocities, the mechanical properties of the formation can be calculated to provide information on the formation, such as sanding, collapsing, compaction, deformation, weak or strong formation, structural boundaries and shapes, such as faults, folds, anti-clines and salt domes. The tool 10, 110 can sense these signals and guide itself to known or programed velocities to follow, and by doing this; a high definition of the reservoir geological structure can be obtained (see FIG. 9). Also the tool can drill in a circular shape, which allows for new drilling and logging methods for maximum well recovery and reservoir characterizations. The new term for these results is high definition (HD) reservoir measurement, which is based on actual measurements and not software predictions.

In general, the construction materials of the downhole laser tool can be of any types of materials that are resistant to the high temperatures, pressures, and vibrations that may be experienced within an existing wellbore, and that can protect the system from fluids, dust, and debris. Materials that are resistant to hydrogen sulfide are also desirable. One of ordinary skill in the art will be familiar with suitable materials.

The laser generating unit can excite energy to a level greater than a sublimation point of the hydrocarbon bearing formation, which is output as the raw laser beam. The excitation energy of the laser beam required to sublimate the hydrocarbon bearing formation can be determined by one of skill in the art. In some embodiments, the laser generating unit can be tuned to excite energy to different levels as required for different hydrocarbon bearing formations. The hydrocarbon bearing formation can include limestone, shale, sandstone, or other rock types common in hydrocarbon bearing formations. The discharged laser beam can penetrate a wellbore casing, cement, and hydrocarbon bearing formation to form, for example, holes or tunnels.

The laser generating unit can be any type of laser unit capable of generating high power laser beams, which can be conducted through a fiber optic cable, such as, for example, lasers of ytterbium, erbium, neodymium, dysprosium, praseodymium, and thulium ions. In some embodiments, the laser generating unit includes, for example, a 5.34-kW Ytterbium-doped multi-clad fiber laser. In some embodiments, the laser generating unit can be any type of laser capable of delivering a laser at a minimum loss. The wavelength of the laser generating unit can be determined by one of skill in the art as necessary to penetrate hydrocarbon bearing formations.

In some embodiments, the laser generating output will be selected to suit a particular application. For example, the size hole that needs to be created to allow the snake robotics to pass through. Because the snake robotics are connected to the laser head, the size of the snake depends on the laser power and vice versa. For example, a 10 kW laser will typically produce a 4-inch hole, so the snake body will need to be less that 4-inches in diameter. However, if a 100 kW laser is used, a much larger hole is created and a much larger snake will be possible.

At least part of the laser tool and its various modifications may be controlled, at least in part, by a computer program product, such as a computer program tangibly embodied in one or more information carriers, such as in one or more tangible machine-readable storage media, for execution by, or to control the operation of, data processing apparatus, for example, a programmable processor, a computer, or multiple computers, as would be familiar to one of ordinary skill in the art.

It is contemplated that systems, devices, methods, and processes of the present application encompass variations and adaptations developed using information from the embodiments described in the following description. Adaptation or modification of the methods and processes described in this specification may be performed by those of ordinary skill in the relevant art.

Throughout the description, where compositions, compounds, or products are described as having, including, or comprising specific components, or where processes and methods are described as having, including, or comprising specific steps, it is contemplated that, additionally, there are articles, devices, and systems of the present application that consist essentially of, or consist of, the recited components, and that there are processes and methods according to the present application that consist essentially of, or consist of, the recited processing steps.

It should be understood that the order of steps or order for performing certain actions is immaterial, so long as the described method remains operable. Moreover, two or more steps or actions may be conducted simultaneously.

What is claimed is:

1. A laser perforation tool configured for use in a downhole environment of a wellbore within a rock formation, the tool comprising:

perforation means configured for perforating the wellbore, the perforation means comprising one or more optical transmission media, the one or more optical transmission media being part of an optical path originating at a laser generating unit configured to generate a raw laser beam, the one or more optical transmission media configured for passing the raw laser beam;

a laser head coupled to the one or more optical transmission media and configured for receiving the raw laser beam, the laser head comprising an optical assembly for controlling at least one characteristic of an output laser beam;

a purging assembly disposed at least partially within or adjacent to the laser head and configured for delivering a purging fluid to an area proximate the output laser beam;

a plurality of orientation nozzles disposed about an outer circumference of the laser head, the plurality of orientation nozzles configured to control orientation of the laser perforation tool within the wellbore, the plurality of orientation nozzles being purge nozzles configured to provide thrust to the laser head to move the laser head within the wellbore and being movably coupled to the laser head to allow the orientation nozzles to rotate or pivot relative to the laser head to provide forward motion, reverse motion, rotational motion, or combinations thereof to the laser head relative to the wellbore; and a control system to control the plurality of orientation nozzles thereby controlling at least one of a motion or a location of the laser head.

2. The tool of claim 1, where the optical assembly comprises:

a splitter prism configured for receiving the raw laser beam and splitting the raw laser beam into one or more beams; and a collimator disposed downstream of the prism and configured to receive the one or more beams and produce the output laser beam having a particular size or shape.

3. The tool of claim 2, where the optical assembly further comprises at least one additional lens disposed between the prism and collimator for delivering the output beam substantially perpendicular to or angled relative to a central axis of the laser head.

4. The tool of claim 2, where the collimator is configured to deliver the output laser beam substantially parallel to a central axis of the laser head.

5. The tool of claim 2, where the collimator is configured to deliver a diverging beam.

6. The tool of claim 2, where the collimator is configured to deliver a converging beam.

7. The tool of claim 2, where the collimator is configured to deliver a collimated beam.

8. The tool of claim 1, where the purging assembly comprises a plurality of purge nozzles disposed proximate the output laser beam and connected to a purge fluid supply, the purge nozzles configured to deliver a purge fluid to an area proximate the output laser beam.

9. The tool of claim 8, where at least a portion of the purge nozzles are vacuum nozzles connected to a vacuum source and configured to remove debris and gaseous fluids from the area proximate the output laser beam.

10. The tool of claim 1, where the tool comprises an articulated arm disposed between the laser head and the laser generating unit.

11. The tool of claim 10, where the articulated arm comprises a plurality of protective couplings disposed around the optical transmission media.

12. The tool of claim 11, where a flexible outer casing is disposed around the plurality of protective couplings.

13. The tool of claim 10, where the articulated arm comprises a snake robot having locomotion means for maneuvering the tool within the wellbore.

14. The tool of claim 13, where the locomotion means comprises at least one of an electrical motor or a hydraulic actuator.

15. The tool of claim 1, further comprising a centralizer coupled to the tool and configured to hold the tool in place relative to an outer casing in the wellbore.

16. The tool of claim 15, where the centralizer comprises a plurality of swellable packers.

17. The tool of claim 1, further comprising at least one acoustic camera coupled to the tool and configured to relay an image of an area proximate the laser head.

18. The tool of claim 17, where the at least one acoustic camera is disposed on the outer circumference of the laser head.

19. The tool of claim 17, where the at least one acoustic camera is also configured to characterize the formation.

20. A method of using a laser tool to stimulate a hydrocarbon-bearing formation, the method comprising the steps of:

passing, through one or more optical transmission media, a raw laser beam generated by a laser generating unit at an origin of an optical path comprising the one or more optical transmission media;

positioning a laser tool within a wellbore within the formation via an articulated arm, the laser tool coupled to the laser generating unit;

orienting a laser head of the laser tool within the wellbore using a plurality of orientation nozzles disposed about an outer circumference of the laser head, the plurality of orientation nozzles configured to control orientation of the laser tool within the wellbore, the plurality of orientation nozzles being purge nozzles that are movably coupled to the laser head to allow the orientation nozzles to rotate or pivot relative to the laser head, the orienting comprising providing, by the purge nozzles, thrust to the laser head to move the laser head within the wellbore to provide forward motion, reverse motion, rotational motion, or combinations thereof to the laser head relative to the wellbore;

delivering the raw laser beam to an optical assembly disposed within the laser head;

manipulating the raw laser beam with the optical assembly to produce an output laser beam; and delivering the output laser beam to the formation.

21. The method of claim 20, further comprising the step of imaging, using one or more acoustic cameras, an area proximate the laser head.

22. The method of claim 20, further comprising the step of characterizing the formation using the one or more acoustic cameras.

* * * * *